US008382245B2

(12) United States Patent
Akahane

(10) Patent No.: US 8,382,245 B2
(45) **Date of Patent: *Feb. 26, 2013**

(54) LIQUID EJECTING APPARATUS

(75) Inventor: Fujio Akahane, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/313,274

(22) Filed: Dec. 7, 2011

(65) Prior Publication Data

US 2012/0081466 A1 Apr. 5, 2012

Related U.S. Application Data

(63) Continuation of application No. 12/871,138, filed on Aug. 30, 2010, now Pat. No. 8,091,981, which is a continuation of application No. 11/473,179, filed on Jun. 23, 2006, now Pat. No. 7,789,492.

(30) Foreign Application Priority Data

Jun. 23, 2005 (JP) ..... 2005-182972

(51) Int. Cl.
*B41J 2/15* (2006.01)

(52) U.S. Cl. ..... 347/40

(58) Field of Classification Search ..... 347/40–43, 347/47, 68, 70–72

See application file for complete search history.

(56) References Cited

U.S. PATENT DOCUMENTS

| | | | | |
|---|---|---|---|---|
| 6,033,058 | A | 3/2000 | Usui et al. | |
| 7,559,631 | B2 | 7/2009 | Shimada et al. | |
| 7,789,492 | B2 | 9/2010 | Akahane | |
| 8,091,981 | B2 * | 1/2012 | Akahane | 347/40 |
| 2003/0076385 | A1 | 4/2003 | Okazawa et al. | |
| 2004/0119780 | A1 * | 6/2004 | Usui et al. | 347/40 |

FOREIGN PATENT DOCUMENTS

| | | | |
|---|---|---|---|
| JP | 9-174833 | A | 7/1997 |
| JP | 10-34923 | A | 2/1998 |
| JP | 2002-127377 | A | 5/2002 |
| JP | 2002-144561 | A | 5/2002 |
| JP | 2002-187278 | A | 7/2002 |
| JP | 2004-1545 | A | 1/2004 |
| JP | 2004-174827 | A | 6/2004 |
| JP | 2004-209656 | A | 7/2004 |
| JP | 2004-209854 | A | 7/2004 |

* cited by examiner

*Primary Examiner* — An Do
(74) *Attorney, Agent, or Firm* — Sughrue Mion, PLLC

(57) ABSTRACT

A liquid ejecting apparatus includes: a plurality of flow channel units, each of which includes a pressure generating chamber operable to generate pressure therein and a nozzle plate formed with a nozzle from which liquid is ejected by the pressure; a plurality of drive units, each of which includes a piezoelectric vibrator operable to apply a pressure vibration to the pressure generating chamber, and which correspond to the plurality of the flow channel units, respectively; and a head casing, in which the plurality of the drive units are stored, and to which the plurality of the flow channel units are fixed.

4 Claims, 9 Drawing Sheets

LIQUID EJECTING APPARATUS

This is a continuation of Ser. No. 12/871,138, now U.S. Pat. No. 8,091,981, filed Aug. 30, 2010, which is a continuation of application Ser. No. 11/473,179 now U.S. Pat. No. 7,789,492, filed Jun. 23, 2006. The entire disclosure of application Ser. Nos. 12/871,138 and 11/473,179 is incorporated herein by reference in its entirety.

BACKGROUND OF THE INVENTION

The present invention relates to a liquid ejecting apparatus which ejects a liquid, supplied from a liquid cartridge and the like, in the form of liquid droplets, and particularly to a liquid ejecting apparatus which enables a high speed printing by realizing a reduction in its size while increasing the number of nozzles of an ejecting head.

As one kind of liquid ejecting apparatus, there is an inkjet recording apparatus. Such an inkjet recording apparatus has advantages of, as well as being able to print directly on a recording medium, being easy to reduce the size of a head, and furthermore that a color printing can also be easily carried out by changing ink colors.

FIG. 8 is one representative example of an ejecting head used for the recording apparatus described heretofore. The ejecting head includes a head casing 76, in which a piezoelectric vibrator 74 serving as pressure generating means is stored, and a flow channel unit 86, which is fixed to a unit fixation surface of the head casing 76 by an adhesive or the like.

The flow channel unit 86 is formed by laminating a flow channel formation substrate 71 formed with a flow channel space including a pressure generating chamber 79, a nozzle plate 70 being laminated to one surface of the flow channel formation substrate 71 and being formed with a nozzle orifice 75 which ejects the ink in the pressure generating chamber 79, and a vibration plate (sealing plate) 72 being laminated to the other surface of the flow channel formation substrate 71 and sealing the flow channel space including the pressure generating chamber 79.

In the nozzle plate 70, a nozzle array 85 is formed by arraying a plurality of the nozzle orifices 75, in this example, two nozzle arrays 85 are formed, each being configured to eject a different kind of ink. The nozzle plate 70 is formed from a stainless steel plate. The pressure generating chambers 79 in communication with each of the nozzle orifices 75 are arranged in the flow channel formation substrate 71. The vibration plate 72 is formed by laminating a stainless steel plate to a polyphenylene sulfide film. The stainless steel plate is etched away to leave necessary portions, thereby forming an island portion (not shown).

The flow channel unit 86 is formed by laminating the nozzle plate 70 to one surface of the flow channel formation substrate 71, and by laminating the vibration plate 72 to the other surface with the island portion disposed on the outer side.

In contrast, the head casing 76, being formed by injection molding a thermosetting resin or a thermoplastic resin, is formed with a storage space 81 penetrating vertically and extending along the nozzle array 85. Also, the unit fixation surface of the head casing 76 is formed with a common ink reservoir 77 communicating with each pressure generating chamber 79 and storing ink to be supplied to each pressure generating chamber 79. Furthermore, the head casing 76 is formed with an ink supply path 78 which supplies the ink reservoir 77 with the ink introduced from a filter unit 88.

Also, a vibrator unit 91 is formed by arranging the bar-like piezoelectric vibrators 74 on the leading end side of a stationary plate 80, and connecting a flexible cable 82 for inputting an ejecting signal to each piezoelectric vibrator 74. The piezoelectric vibrators 74 have longitudinal vibration mode.

The vibrator unit 91 is stored in the storage space 81 of the head casing 76 with the leading end of each piezoelectric vibrator 74 projecting from the unit fixation surface, and the vibration plate 72 of the flow channel unit 86 is bonded by the adhesive to the unit fixation surface of the head casing 76. In this condition, the leading end face of the piezoelectric vibrator 74 is fixed to the island portion of the vibration plate 72, and the stationary plate 80 is adhesively fixed to the head casing 76.

A head substrate 87 is disposed on a side of the head casing 76 opposite the unit fixation surface and, furthermore, the filter unit 88 is attached to the head substrate 87, thereby forming the ejecting head 100.

A hollow ink introduction needle 90, which is supplied with the ink from a not-shown ink cartridge and the like, stands on the filter unit 88, and a filter 89 which filters ink is provided in a root portion of the ink introduction needle 90. In the figure, a seal member 94 seals an ink supply opening 95 of the filter unit 88 and an ink supply path 78 of the head casing 76 so as to maintain a liquid-tightness therebetween.

Flanges 92*b*, each of which an attachment hole 93*b* for attaching the ejecting head 100 to a not-shown carriage and the like is bored in, are formed at both side portions of the filter unit 88. Similarly, flanges 92*a*, each of which an attachment hole 93*a* is bored in, are also formed at both side portions of the head casing 76. The holes and flanges function as attachment holes 93 and flanges 92 which are integrated and stacked one on the other in an assembled condition.

In the ejecting head 100 of the configuration described heretofore, the piezoelectric vibrator 74 is extended and contracted in a longitudinal direction thereof by inputting a drive signal generated by a not-shown drive circuit to the piezoelectric vibrator 74 via the flexible cable 82. The ejecting head 100 is configured in such a way that the island portion of the vibration plate 72 is vibrated by the extension and contraction of the piezoelectric vibrator 74 to vary a pressure in the pressure generating chamber 79, thereby ejecting the ink in the pressure generating chamber 79 from the nozzle orifice 75 as ink droplets.

At this point, as an inkjet recording apparatus having head chips staggered, one shown in JP-A-2002-127377 is disclosed.

In recent years, in order to realize a high speed printing, an increase in the number of nozzles of the ejecting head 100 has been considered. However, when intending to increase the number of nozzles of one ejecting head 100, each part, such as the nozzle plate 70, the flow channel formation substrate 71 and the vibrator unit 91, which form the ejecting head, has to be increased in size. When each part is thus increased in size, it becomes difficult to maintain a high processing accuracy, and processing equipment has to be subjected to an overhaul in order to carry out a processing with high accuracy. Moreover, when intending to fabricate large-size parts with high accuracy, a significant reduction even in yield cannot be avoided. Consequently, an increase in the size of parts results in an extreme increase in cost, constituting a limitation realistically.

At this point, it has been considered that one head unit 101 is formed by arranging a plurality of the ejecting heads 100 described heretofore, thereby increasing the number of nozzles of the one head unit 101.

FIG. 9 shows an example of the head unit 101 formed by arranging a plurality of the ejecting heads 100. In this example, the unit head 101 is formed by arranging two ejecting heads 100, each having two nozzle arrays 85, in a main scanning direction X. Then, two ejecting heads 100*a* and 100*b* are positioned in such an offset manner that a nozzle array 85 end downstream of one ejecting head 100*a* in a paper transport direction (a Y direction) is aligned with a nozzle array 85 end upstream of the other ejecting head 100*b* in the paper transport direction (Y direction).

Such a head unit 101, being mounted on the not-shown carriage, reciprocates in the main scanning direction X, and ejects ink droplets from the nozzle orifices 75 forming each nozzle array 85 while transporting a recording medium toward a sub-scanning direction Y, thereby forming an image on the recording medium using a dot matrix.

When the plurality of ejecting heads 100 are thus arranged, since the flange 92 and the like which are attachment members for attaching ejecting head 100 are formed for each ejecting head 100, some distance is required between the ejecting heads 100, providing a so-called dead space, which leads to an increase in the size of the head unit 101 itself, thereby increasing the size of the recording apparatus itself.

Moreover, the plurality of ejecting heads 100 need to be positioned with accuracy. Particularly, as a relative displacement of the two ejecting heads 100 in the Y direction, which is the paper transport direction, cannot be electrically corrected, their physical attachment positions need to be determined with high accuracy. Consequently, there has been the problem wherein an accurate physical positioning operation has to be carried out each time each ejecting head 100 is attached.

SUMMARY

It is therefore an object of the invention to provide a liquid ejecting apparatus which enables a high speed printing by realizing a reduction in the size of an ejecting head while increasing the number of nozzles.

In order to achieve the object, according to the invention, there is provided a liquid ejecting apparatus comprising:

a plurality of flow channel units, each of which includes a pressure generating chamber operable to generate pressure therein and a nozzle plate formed with a nozzle from which liquid is ejected by the pressure;

a plurality of drive units, each of which includes a piezoelectric vibrator operable to apply a pressure vibration to the pressure generating chamber, and which correspond to the plurality of the flow channel units, respectively; and a head casing, in which the plurality of the drive units are stored, and to which the plurality of the flow channel units are fixed.

A first one of the plurality of the flow channel units may include a plurality of the nozzles arranged in an array direction with a predetermined pitch. A second one of the plurality of the flow channel units may include a plurality of the nozzles arranged in the array direction with the predetermined pitch. The first one and the second one of the plurality of the flow channel units may be staggered so that the plurality of the nozzles of the first one and the second one of the plurality of the flow channel units are arranged in the array direction with the predetermined pitch.

The liquid ejecting may further include a head substrate, corresponding to the plurality of the drive units.

The liquid ejecting may further include a liquid introduction member, corresponding to the plurality of the flow channel units.

The plurality of the flow channel units may be formed with first holes, respectively. The head casing may be formed with second holes which correspond to the first holes, respectively. The plurality of the flow channel units may be positioned with respect to the head casing by inserting pins through the first holes and the second holes, respectively.

DETAIL DESCRIPTION OF PREFERRED EMBODIMENTS

Next, an embodiment of the invention will be described in detail.

Figure 1:
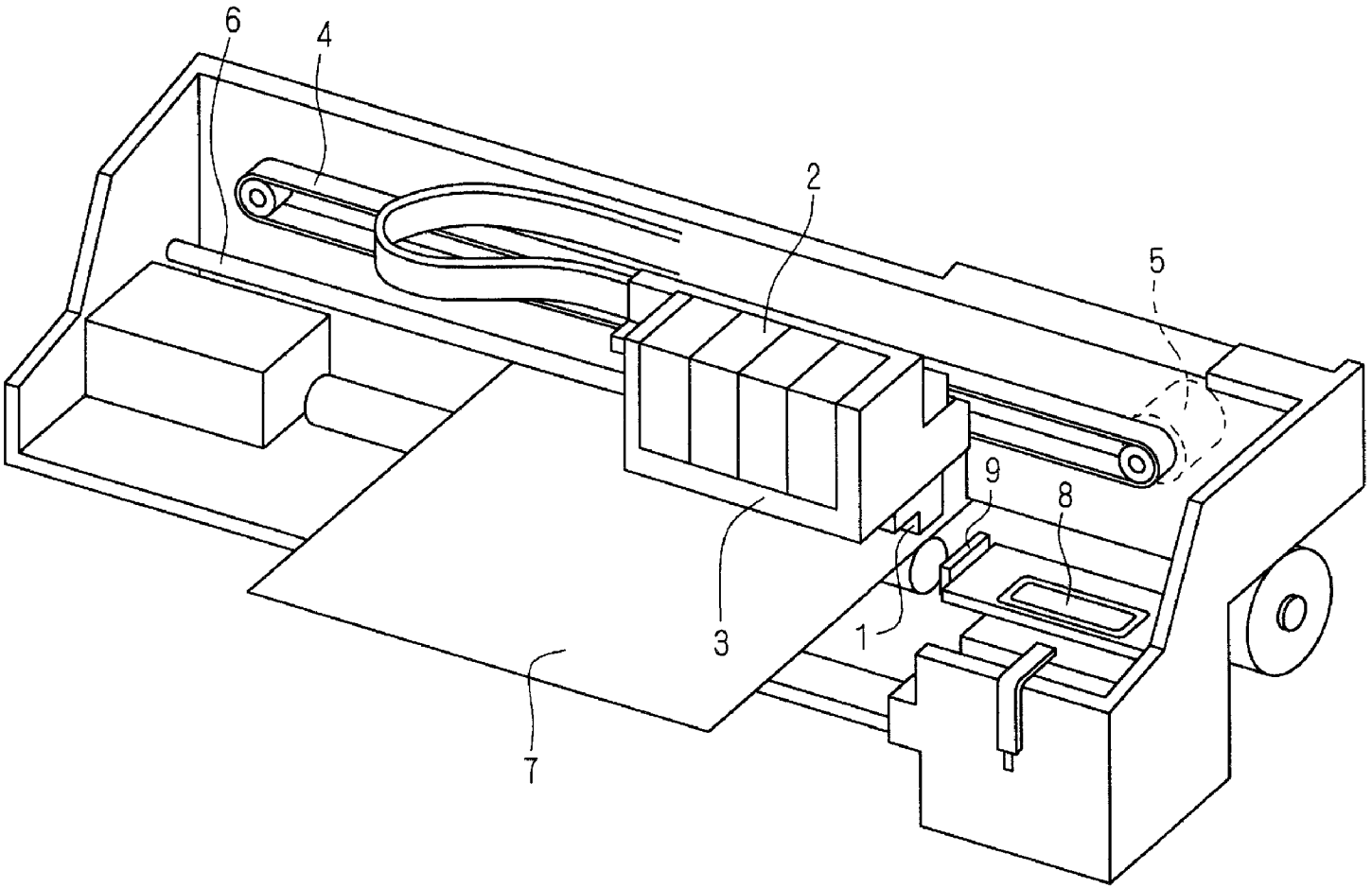
FIG. 1 is a schematic configuration view showing an example of a recording apparatus to which the invention is applied.

FIG. 1 is a view showing an example of a peripheral structure of an inkjet recording apparatus applying the liquid ejecting apparatus of the invention.

The recording apparatus includes a carriage 3 on the top of which an ink cartridge 2 serving as a liquid supply source is mounted and to the underside of which an ejecting head 1 ejecting ink droplets is attached.

The carriage 3, being connected to a stepping motor 5 via a timing belt 4, is configured in such a way as to, while being guided by a guide bar 6, reciprocate in a paper width direction of a recording paper 7. Also, the ejecting head 1 is attached to a surface (in this example, the underside) of the carriage 3 facing the recording paper 7. A configuration is such that the ejecting head 1 is supplied with ink from the ink cartridge 2 and, while the carriage 3 is being moved, ejects ink droplets onto an upper surface of the recording paper 7, thereby printing an image and a character on the recording paper 7 using a dot matrix.

In the figure, a capping device 8 is provided in a nonprinting area within a moving range of the carriage 3, and by sealing nozzles of the ejecting head 1 during a cessation of printing, prevents nozzle orifices insofar as possible from drying. Also, the capping device 8 is configured in such a way as to, by applying a negative pressure to the inside of a cap by means of a suction pump, compulsorily suck ink from the nozzle orifices and restore the clogged nozzle orifices. Furthermore, a wiping device 9 wipes a nozzle surface of a head body after the suction.

Figure 2:
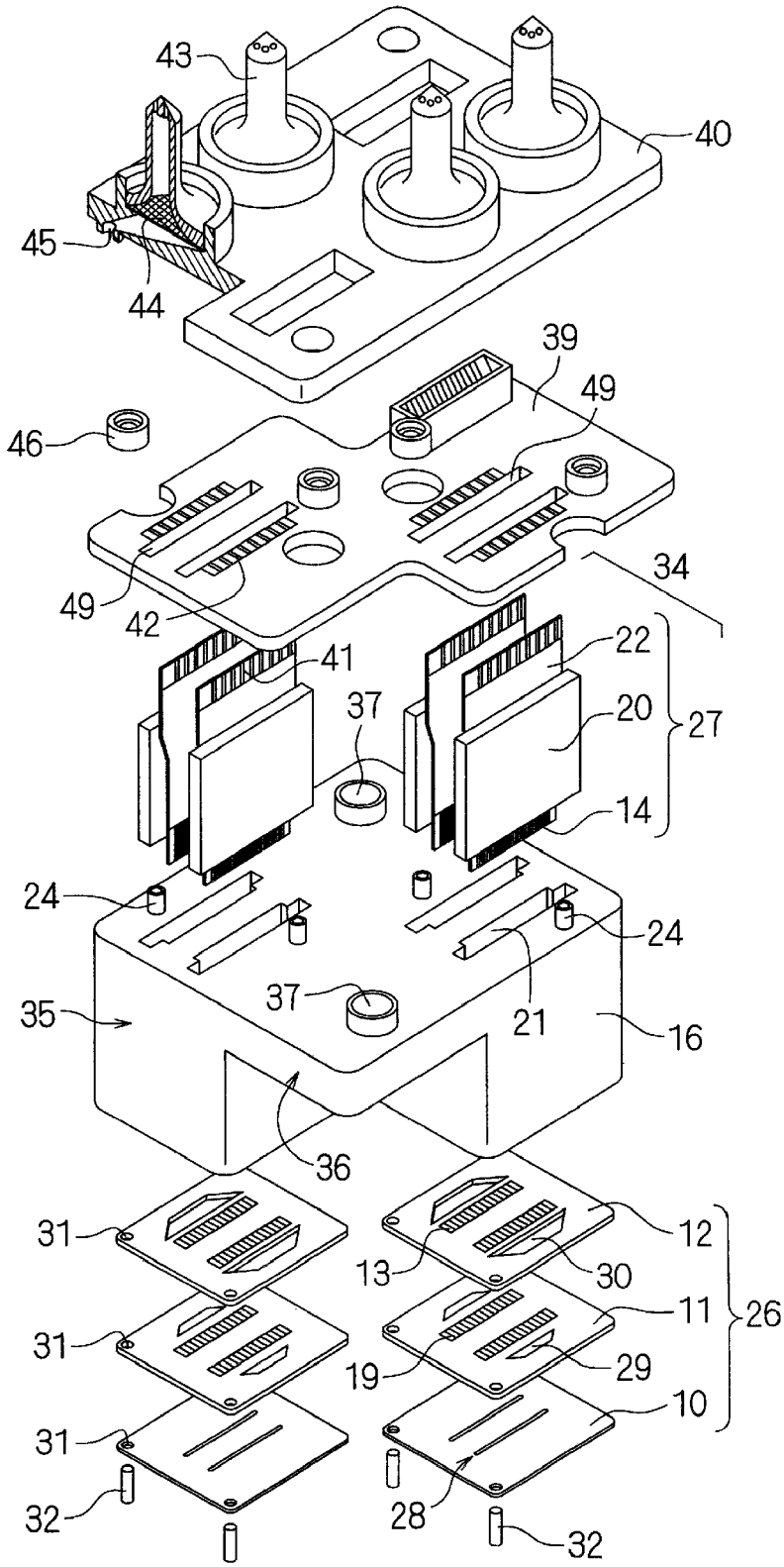
FIG. 2 is an exploded perspective view showing a head unit.
Figure 3:
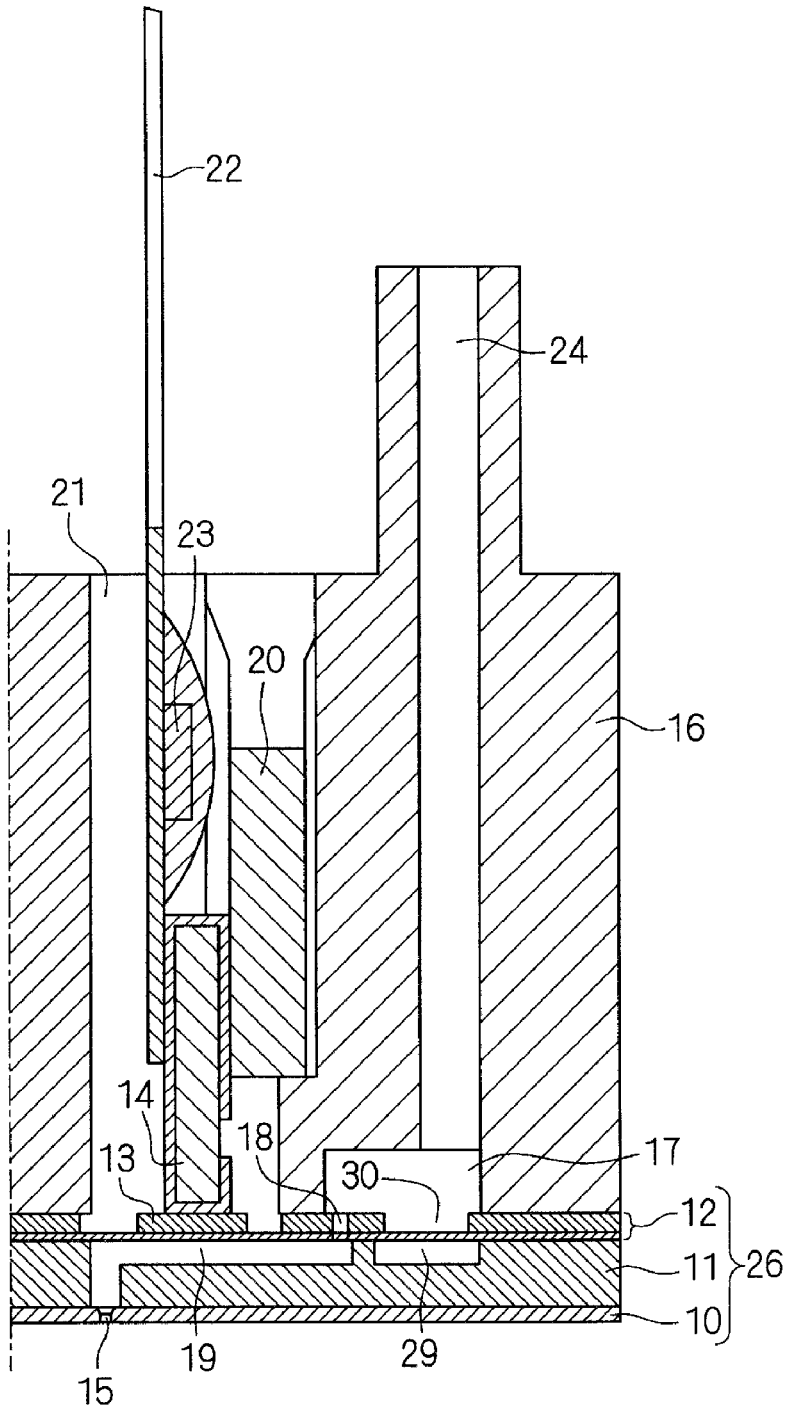
FIG. 3 is a sectional view of a portion of the head unit.

FIG. 2 is an exploded perspective view showing the ejecting head 1 according to an embodiment of the invention, and FIG. 3 is a sectional view for illustrating details of a vibrator unit 27 and a flow channel unit 26 of the ejecting head 1.

As shown in the figures, the ejecting head 1 includes the flow channel unit 26 including a pressure generating chamber 19 which generates a pressure for ejecting ink from nozzles, a drive unit 34 including a piezoelectric vibrator 14 serving as pressure generating means with respect to the pressure generating chamber 19, and a head casing 16 in which is the drive unit 34 stored and to a unit fixation surface (a lower surface as seen in the figure) of which the flow channel unit 26 is fixed.

The flow channel unit 26 is formed by laminating a flow channel formation substrate 11 formed with a flow channel space including the pressure generating chamber 19, a nozzle plate 10 which, being laminated to one surface of the flow channel formation substrate 11, is formed with a nozzle orifice 15 which ejects the ink in the pressure generating chamber 19, and a vibration plate (sealing plate) 12 which, being laminated to the other surface of the flow channel formation substrate 11, seals the flow channel space including the pressure generating chamber 19.

The nozzle plate 10, having two nozzle arrays 28 formed by arraying a plurality of the nozzle orifices 15 at a pitch P corresponding to a prescribed resolution (dot pitch), is configured to eject ink droplets from each nozzle orifice 15. The nozzle plate 10 is formed from a stainless steel plate.

The pressure generating chambers 19 in communication with each of the nozzle orifices 15 are arranged in the flow channel formation substrate 11. Also, a damper chamber 29 for releasing a pressure fluctuation of a to-be-described ink reservoir 17 is formed in the flow channel formation substrate 11. Spaces to provide the pressure generating chambers 19 and the damper chamber 29 are formed as recesses on a vibration plate 12 side of the flow channel formation substrate 11. The flow channel formation substrate 11 is formed by etching, in this example, a silicon single crystal substrate.

The vibration plate 12 is formed by laminating a polyphenylene sulfide film and a stainless steel plate. The stainless steel plate is etched away to leave necessary portions, thereby forming an island portion 13, which applies a pressure vibration to the pressure generating chamber 19, and the like. Also, the vibration plate 12 is formed with an ink supply opening 18 for supplying each pressure generating chamber 19 with the ink in the to-be-described ink reservoir 17, and a damper opening 30 is formed in a portion of the vibration plate 12 corresponding to the damper chamber 29 and the ink reservoir 17.

The flow channel unit 26 is formed by laminating the nozzle plate 10 to one surface of the flow channel formation substrate 11, and by laminating the vibration plate 12 to the other surface with the island portion 13 disposed on the outer side. The flow channel formation substrate 11, the nozzle plate 10 and the vibration plate 12 are coated with an adhesive, bonded by heating and maintaining them at a prescribed high temperature, and thereafter cooled down to a room temperature, thereby forming the flow channel unit 26.

Also, the nozzle plate 10, the flow channel formation substrate 11 and the vibration plate 12 each have bored, in the vicinity of each of two corners thereof, a first positioning hole 31 through which a positioning pin 32 is inserted with the flow channel unit 26 formed by laminating them.

The drive unit 34 includes a number of vibrator units 27 corresponding to the number of nozzle arrays 28 in the flow channel unit 26. In this example, as the flow channel unit 26 is formed with two nozzle arrays 28, the drive unit 34 corresponding to the flow channel unit 26 includes a pair of two vibrator units 27.

The vibrator unit 27 is formed by fixing the bar-like piezoelectric vibrators 14, which are arranged so as to correspond to the pressure generating chambers 19, to the leading end of a stationary plate 20, and connecting a flexible cable 22, for inputting an ejection signal, to each of the piezoelectric vibrators 14. The piezoelectric vibrators 14 have longitudinal vibration mode.

Figure 4A:
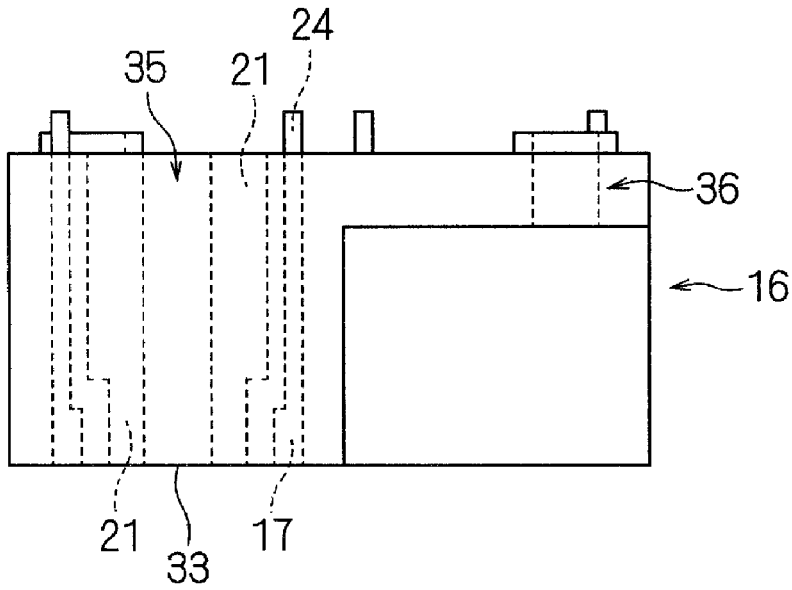
FIGS. 4A and 4B are views showing a head casing.
Figure 4B:
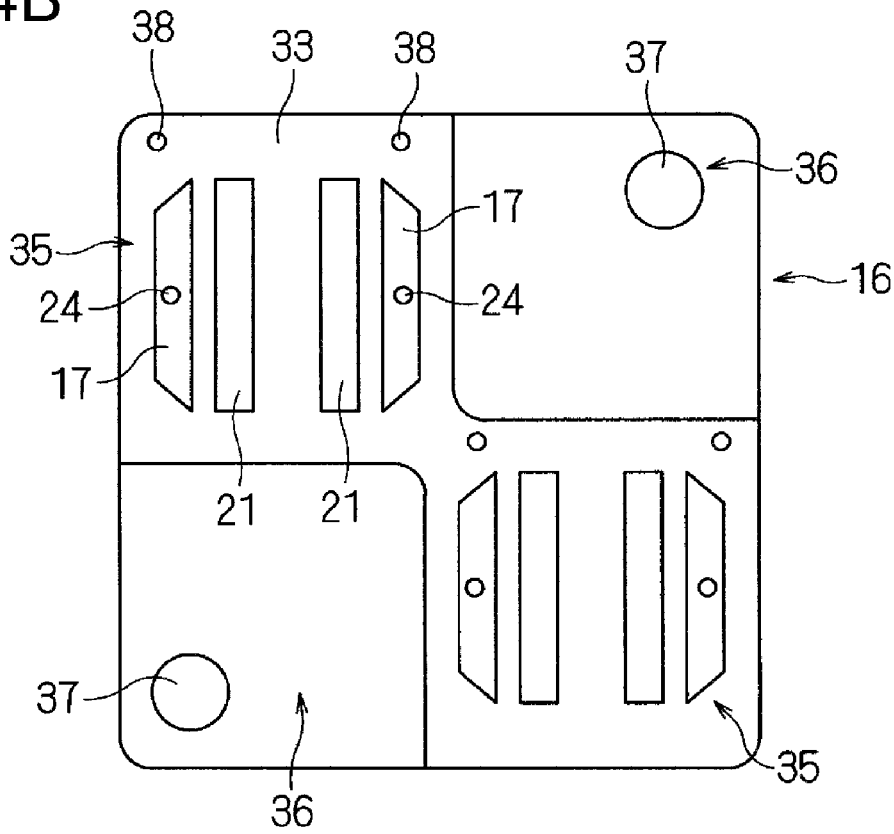

FIGS. 4A and 4B are views showing the head casing 16, and FIG. 4A is a front view, and FIG. 4B is a view seen from a unit fixation surface 33.

The head casing 16, being formed by injection molding a thermosetting resin, includes a substantially block-shaped unit assembly portion 35 and a substantially plate-shaped attachment portion 36.

The unit assembly portion 35 is a portion in which are assembled the drive unit 34 and the flow channel unit 26, while the attachment portion 36 is a substantially plate-shaped portion in which is bored an attachment hole for attaching the ejecting head 1 itself to the carriage 3 and the like. In this example, the head casing 16 is provided with two each of the unit assembly portion 35 and the attachment portions 36. The unit assembly portions 35 and the attachment portions 36 are arranged in an alternate manner (in other words, in a staggered manner).

The unit assembly portions 35 of the head casing 16, each being formed with two storage spaces 21 penetrating vertically and extending in a direction of the nozzle array (a nozzle array 28 direction), are configured in such a way that the vibrator units 27 are stored, one in each storage space 21.

Also, the common ink reservoir 17, which stores ink to be supplied to each pressure generating chamber 19, is recessed, so as to correspond to a line of the pressure generating chambers 19, in the unit fixation surface 33 of each unit assembly portion 35, in such a way that the common ink reservoir 17 is disposed along the line of the pressure generating chambers 19. Also, the unit assembly portions 35 are each formed with an ink flow channel 24 through which ink is supplied to the ink reservoir 17.

Furthermore, second positioning holes 38, through which the positioning pins 32 are inserted to position the flow channel unit 26, are formed, one in each of two places in the vicinity of a corner of the unit fixation surface 33.

The ejecting head 1, as well as being equipped with a plurality (in this example, two) of the flow channel units 26, is equipped with a plurality (in this example, two pairs) of the drive units so as to correspond to the flow channel units 26. The ejecting head 1 is formed by, as well as storing the plurality of drive units 34 in the common head casing 16, fixing the plurality of flow channel units 26 to the common head casing 16 so as to correspond to the drive units 34.

In this condition, the vibration plate 12 of the flow channel unit 26 is bonded by the adhesive to the unit fixation surface 33 of the head casing 16, the leading end face of the piezoelectric vibrator 14 stored in the storage space 21 is fixed to the island portion 13 of the vibration plate 12, and the stationary plate 20 is adhesively fixed to the head casing 16.

At this time, the flow channel unit 26 is positioned by inserting the positioning pins 32 through both the first positioning holes 31 formed in the flow channel unit 26 and the second positioning holes 38 formed in the head casing 16.

Figure 5A:
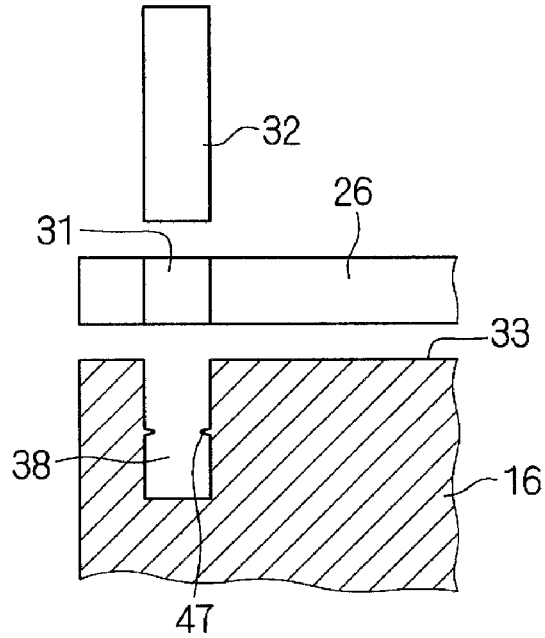
FIGS. 5A, 5B and 5C are views for illustrating an attached condition of a flow channel unit.
Figure 5B:
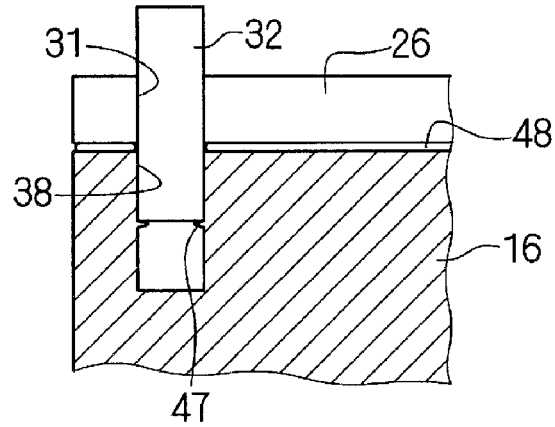
Figure 5C:
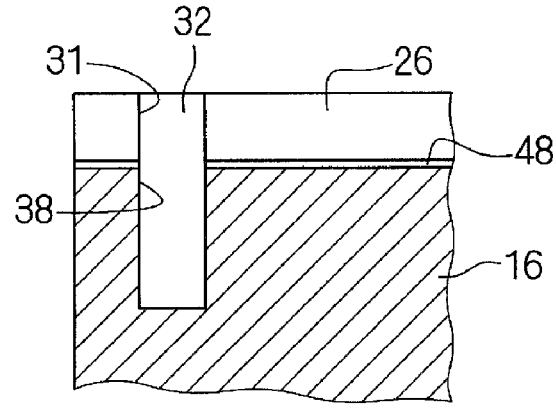

FIGS. 5A to 5C are views showing a condition in which a positioning is carried out by attaching the flow channel unit 26 to the head casing 16. As shown in FIG. 5A, the second positioning hole 38 has a minute projection 47 on the inner surface of a halfway portion in a depth direction, and the positioning pin 32 is set to have a length in the order of magnitude obtained by adding the thickness of the flow channel unit 26 and the depth of the second positioning hole 38.

First, as shown in FIG. 5B, an adhesive 48 is coated on the unit fixation surface 33 of the head casing 16, the flow channel unit 26 is placed on the unit fixation surface 33, and the flow channel unit 26 is positioned in such a way that the first positioning hole 31 and the second positioning hole 38 are substantially concentric with each other. In this condition, the positioning pin 32 is inserted through both the first positioning hole 31 and the second positioning hole 38, and pressed down to the minute projection 47. In this condition, the adhesive 48 is cured and then, as shown in FIG. 5C, the positioning pin 32 is pressed down to the bottom of the second positioning hole 38.

Furthermore, a head substrate 39 is disposed on a side of the head casing 16 opposite the unit fixation surface 33 and, further still, a filter unit 40 is attached to the head substrate 39, thereby forming the ejecting head 1.

The head substrate 39 is formed with a slit 49 through which is inserted the flexible cable 22 of the vibrator unit 27 forming each drive unit 34. Two pairs of two slits 49 are formed so as to correspond to the drive units 34. Also, the head substrate 39 is formed with a contact point 42 forelectrically connecting with a contact point 41 of the flexible cable 22.

In the ejecting head 1, the head substrate 39 is a single head substrate 39 common to the plurality of drive units 34.

Also, ink introduction needles 43, which are supplied with ink from the ink cartridge 2, stand on the filter unit 40. Four ink introduction needles 43 are provided so as to correspond to the ink flow channels 24. That is, in this example, the ink reservoirs 17, the ink flow channels 24, the vibrator units 27 and the ink introduction needles 43 are provided so as to correspond to the nozzle arrays 28.

A filter 44 which filters the introduced ink is provided in a root portion of each ink introduction needle 43. In the figure, a seal member 46 seals an ink supply path 45 of the filter unit 40 and the ink flow channel 24 of the head casing 16 so as to maintain a liquid-tightness therebetween. Also, attachment holes 50 corresponding to the attachment holes 37 of the head casing 16 are bored in the filter unit 40.

In the ejecting head 1, the filter unit 40 is a single filter unit 40 common to the plurality of flow channel units 26.

The ejecting head 1 of the configuration described heretofore is extended and contracted by inputting a drive signal generated by the drive circuit 23 to the piezoelectric vibrator 14 via the flexible cable 22. The ejecting head 1 is configured in such a way that the island portion 13 of the vibration plate 12 is vibrated by the extension and contraction of the piezoelectric vibrator 14 to vary a pressure in the pressure generating chamber 19, thereby ejecting the ink in the pressure generating chamber 19 from the nozzle orifice 15 in the form of ink droplets.

Figure 6:
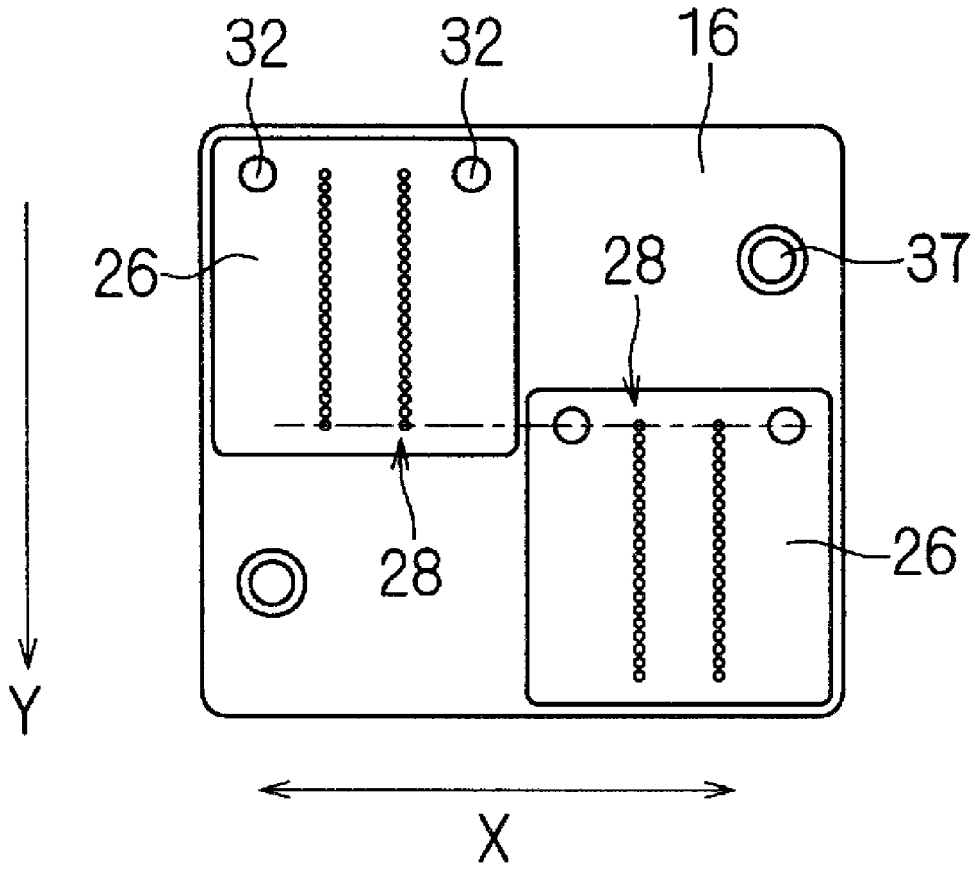
FIG. 6 is a view of the head unit as seen from a nozzle surface side.

FIG. 6 shows a first example of the ejecting head 1 as seen from a nozzle surface side. In this example, two flow channel units 26 are offset, i.e., staggered with respect to each other. The drive units 34, as well as the flow channel units 26, are staggered in such a way that the nozzle orifices 15 which eject the same color ink are arrayed at a prescribed pitch in the nozzle array 28 direction.

That is, in this example, two nozzle arrays 28 are formed in each flow channel unit 26. In the flow channel unit 26, the nozzle arrays 28 are arranged along a paper transport direction (a Y direction) and parallel to a paper width direction (an X direction) perpendicular to the nozzle arrays 28.

In each nozzle array 28, the nozzles are arrayed at the pitch P corresponding to the prescribed resolution (dot pitch). The plurality (in this example, two) of flow channel units 26 are offset and staggered with respect to each other in such a way that they are displaced in the Y direction by a length of the nozzle arrays 28. In the overall configuration of the head unit 1, two nozzle arrays 28 of the same color are arrayed in the nozzle array 28 direction (a transport direction of the recording paper 7; the Y direction). That is, each flow channel unit 26 is disposed with its position determined in such a way that distance between a nozzle provided at a flow channel unit 26 end and a nozzle provided at the adjacent flow channel unit 26 end in a paper transport direction, is the pitch P corresponding to the dot pitch.

The nozzle surface of the ejecting head 1 is caused to face the recording paper 7, and ink is ejected from necessary nozzles in response to image information, thereby recording an image corresponding to the image information on the recording paper 7. At this time, ink is ejected from the two nozzle arrays 28 during one stroke of the ejecting head 1 in the X direction, thus enabling a high speed printing.

Figure 7:
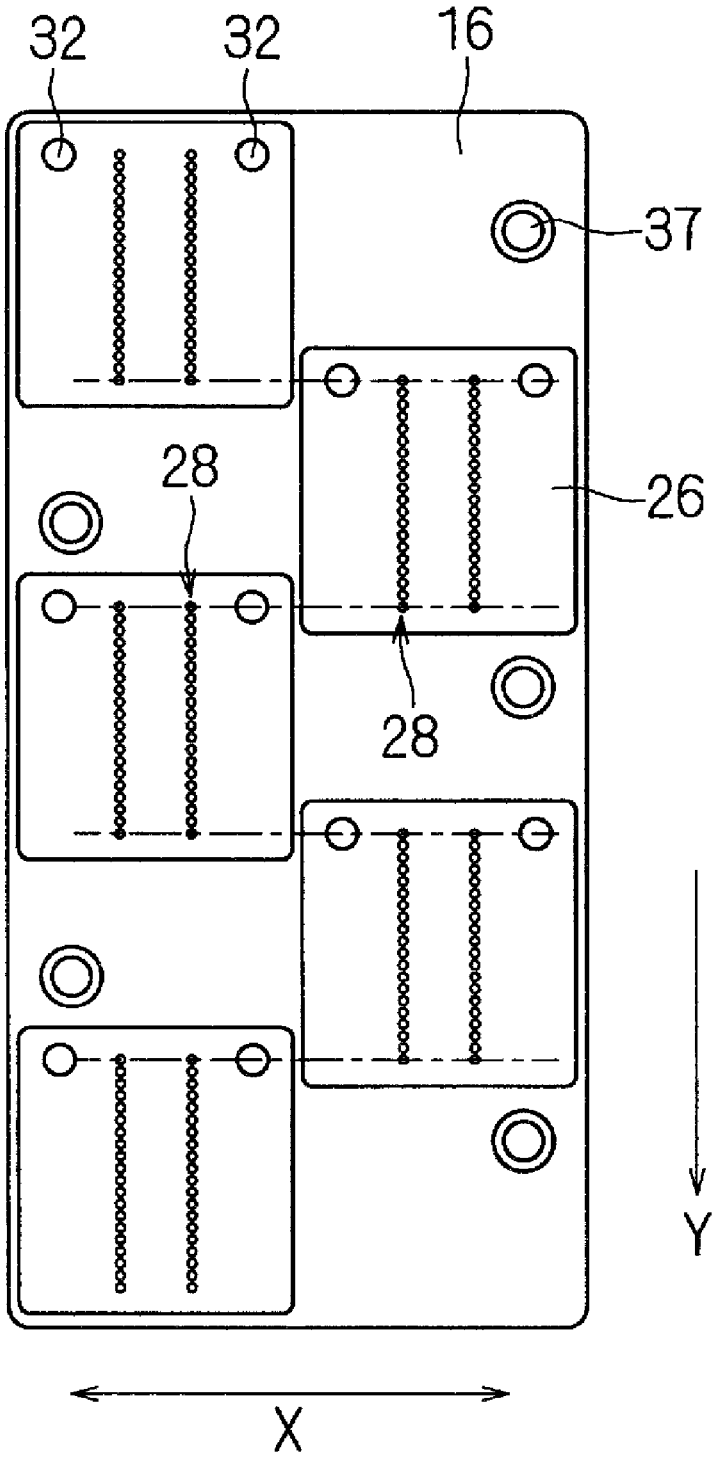
FIG. 7 is a view showing a second example of the head unit.
Figure 8:
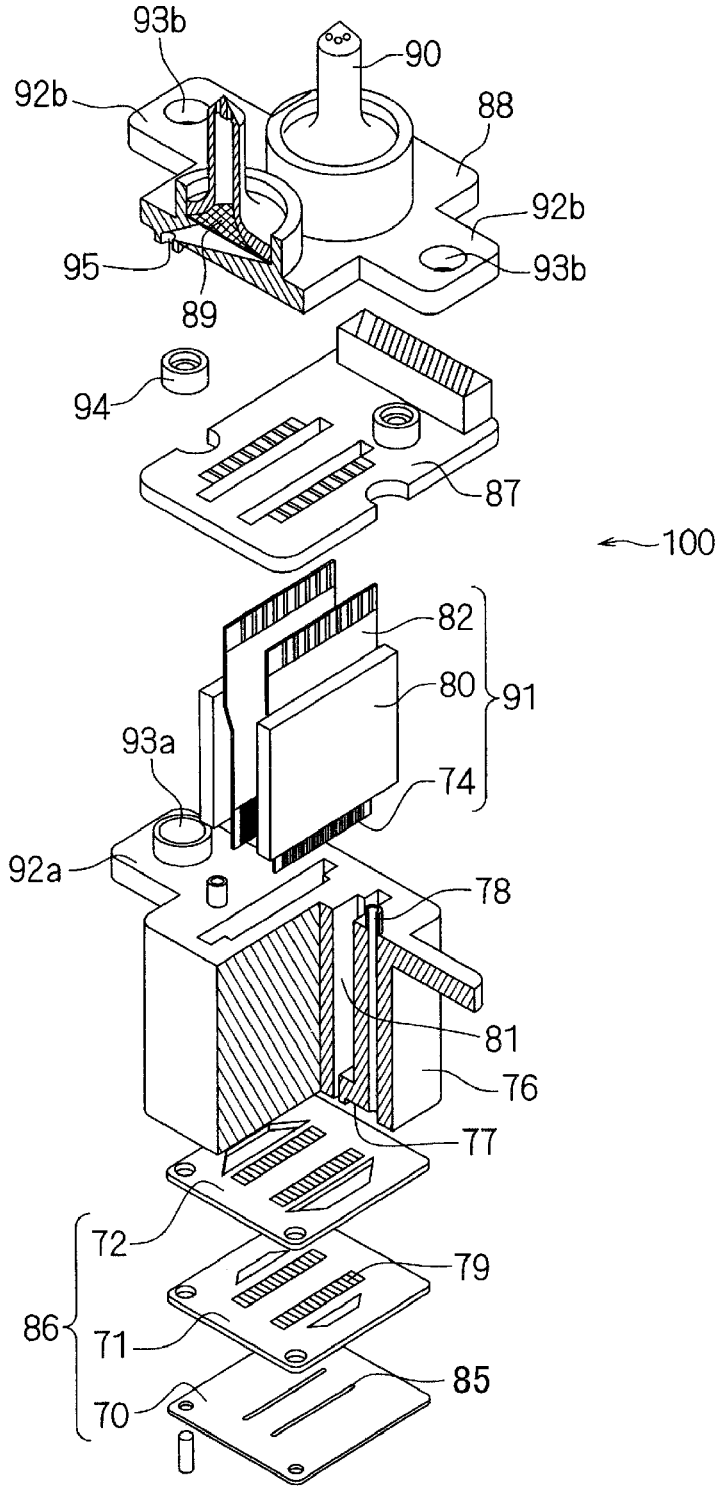
FIG. 8 is an exploded perspective view showing a related art.
Figure 9:
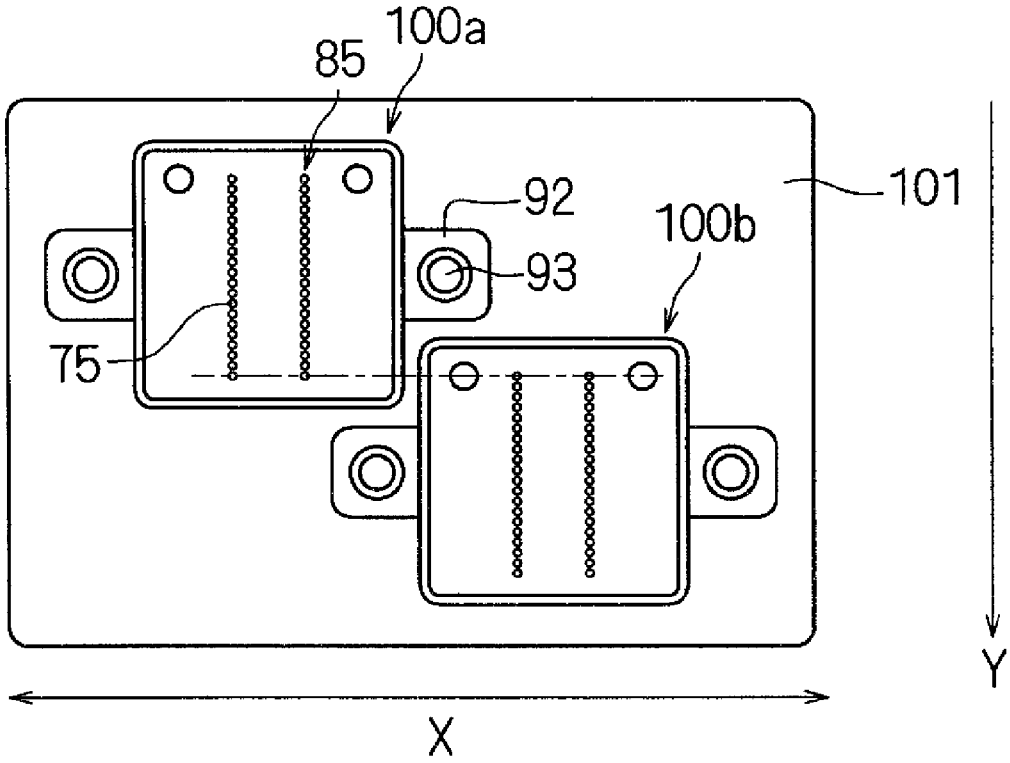
FIG. 9 is a view of the related art as seen from a nozzle surface side.

FIG. 7 shows a second example of the recording apparatus to which the invention is applied.

In the first example, the ejecting head 1 is formed by attaching two flow channel units 26 and two pairs of drive units 34 to one common head casing 16, while, in this example, the ejecting head 1 is formed by attaching five flow channel units 26 and five pairs of drive units 34 to one common head casing 16. In this way, it is not the intent of the invention to limit the number of flow channel units 26 and drive units 34 attached to one common head casing 16.

According to the above configuration, in the invention, a plurality of the flow channel units 26 is provided, and a plurality of the drive units 34 is provided so as to correspond to the flow channel units 26, wherein the plurality of drive units 34 is stored in a common head casing 16, and the plurality of flow channel units 26 is fixed to the common head casing 16 so as to correspond to the drive units 34. For this reason, instead of arranging a plurality of the ejecting heads in the related art, the ejecting head 1 is formed by, as well as storing the plurality of drive units 34 in the common head casing 16, fixing the plurality of flow channel units 26 to the common head casing 16. Therefore, a distance between the drive units 34, as well as the flow channel units 26, is shortened to reduce a dead space, thereby realizing a reduction in the size of the ejecting head while increasing the number of nozzles. Furthermore, instead of carrying out an attachment while determining a position for each ejecting head as used in the related art, the drive units 34 and the flow channel units 26 are attached to the head casing 16 made with a prescribed accuracy. Therefore, it is possible to significantly simplify a positioning operation as compared with the related art. Moreover, instead of increasing the size of the drive units 34 and the flow channel units 26 themselves, as parts used in the related ejecting head can be shared, there is no problem of an overhaul of processing equipment and a reduction in yield which result from an increase in the size of the vibrator units 27 and the flow channel units 26, and an increase in cost is also minimized. Particularly, since the drive units 34 and the flow channel units 26, an increase in the size of which leads to an extreme increase in cost and an extreme reduction in yield, are shared, the advantageous effect is noticeable.

Also, the drive units 34, as well as the flow channel units 26, are staggered in such a way that nozzle orifices 15 which eject the same kind of liquid are arrayed at a prescribed pitch in the nozzle array 28 direction. Therefore, instead of arranging a plurality of the ejecting heads in the related art, the ejecting head 1 is formed by storing a plurality of the drive heads 1 and the flow channel units 26. Therefore, a distance between the drive units 34, as well as the flow channel units 26, is shortened to reduce a dead space, thereby realizing a reduction in the size of the ejecting head 1 while increasing the number of nozzles, enabling a high speed printing.

Also, a common head substrate 39 is provided with respect to the plurality of drive units 34. Therefore, by sharing the head substrate 39, it is possible to, as well as improving an assembly operating efficiency by reducing the number of parts, unify controls with a configuration such that control signals are input to the plurality of drive units 34 through the common head substrate 39.

Also, a common filter unit 40 is provided with respect to the plurality of flow channel units 26. Therefore, by sharing the filter unit 40, it is possible to improve an assembly operating efficiency by reducing the number of parts.

Also, the flow channel units 26 are each positioned by inserting a positioning pin 32 through both a first positioning hole 31 formed in the flow channel unit 26 and a second positioning hole 38 formed in the head casing 16. Therefore, instead of carrying out an attachment while determining a position for each ejecting head as used in the related art, as the plurality of flow channel units 26 is attached to the head casing 16 made with a prescribed accuracy while the plurality of flow channel units 26 is each being positioned by the positioning pin 32, a positioning operation can be significantly simplified as compared with the related art.

Also, instead of positioning the flow channel units 26 by the positioning pin 32, it is also acceptable that the flow channel units 26 are each positioned in the following manner. That is, an adhesive 48 is coated on the unit fixation surface 33 of the head casing 16, and the flow channel unit 26 is temporarily attached thereto. Then, the flow channel unit 26 is positioned by fine adjusting the position of the flow channel 26 so that it is projected by a magnifying glass and aligned with an alignment mask. Thereafter, the adhesive 48 is cured while the position of the flow channel unit 26 is being maintained.

The invention can be applied to a liquid ejecting apparatus and, as its representative example, there is an inkjet recording apparatus equipped with an inkjet recording head for image recording. Other examples of the liquid ejecting apparatus include an apparatus equipped with a color material ejecting head for use in manufacturing a color filter for a liquid crystal display or the like, an apparatus equipped with an electrode material (electrically conductive paste) ejecting head for use in forming an electrode for an organic light emitting display, a surface emitting display (FED) or the like, an apparatus equipped with a living organic material ejecting head for use in manufacturing biochips, an apparatus equipped with a sample ejecting head as a precision pipette, and the like.

What is claimed is:

1. A liquid ejecting head comprising:

a first flow channel element which includes a first nozzle plate formed with a first nozzle row defined by a plurality of nozzles arranged in a first direction with a pitch;

a second flow channel element which includes a second nozzle plate formed with a second nozzle row defined by a plurality of nozzles arranged in the first direction with the pitch;

a head casing to which the first flow channel element and the second flow channel element are fixed; and a filter element having a plurality of filters and common to the first flow channel element and the second flow channel element, wherein the first nozzle row and the second nozzle row are displaced in a second direction perpendicular to the first direction; and the second nozzle row has a nozzle whose distance in the first direction to one of the nozzles in the first nozzle row is equal to the pitch.

2. The liquid ejecting head according to claim 1, wherein the first flow channel element is fixed to the head casing by first positioning pin; and the second flow channel element is fixed to the head casing by second positioning pin.

3. The liquid ejecting head according to claim 1, further comprising:

a first drive element configured to eject liquid from nozzles in the first nozzle row;

a second drive element configured to eject liquid from nozzles in the second nozzle row; and a head substrate has a first contact point connected to the first drive element and a second contact point connected to the second drive element.

4. A recording apparatus comprising the liquid ejecting head according to claim 1.

* * * * *